US009459555B2

(12) United States Patent
Fujii et al.

(10) Patent No.: US 9,459,555 B2
(45) Date of Patent: Oct. 4, 2016

(54) IMAGE FORMING APPARATUS

(71) Applicant: BROTHER KOGYO KABUSHIKI KAISHA, Nagoya-shi, Aichi-ken (JP)

(72) Inventors: Yasumasa Fujii, Chiryu (JP); Tatsuo Ogasawara, Kasugai (JP); Hiroki Mori, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/526,608

(22) Filed: Oct. 29, 2014

(65) Prior Publication Data

US 2015/0117879 A1 Apr. 30, 2015

(30) Foreign Application Priority Data

Oct. 31, 2013 (JP) ..... 2013-227749

(51) Int. Cl.
*G03G 15/08* (2006.01)

(52) U.S. Cl.
CPC ..... *G03G 15/0862* (2013.01); *G03G 15/0822* (2013.01)

(58) Field of Classification Search
CPC ..... G03G 15/0822; G03G 15/0862
See application file for complete search history.

(56) References Cited

U.S. PATENT DOCUMENTS 5,012,285 A * 4/1991 Oka et al. ..... 399/260
6,151,471 A * 11/2000 Yahata ..... G03G 15/0822 399/258
6,256,471 B1 * 7/2001 Sato et al. ..... 399/284
2003/0133719 A1 * 7/2003 Tsuruya ..... G03G 15/0896 399/12
2007/0092301 A1 * 4/2007 Bessette ..... 399/254

FOREIGN PATENT DOCUMENTS

JP 2002-181157 A 6/2002

* cited by examiner

*Primary Examiner* — David Gray
*Assistant Examiner* — Thomas Giampaolo, III
(74) *Attorney, Agent, or Firm* — Merchant & Gould P.C.

(57) ABSTRACT

An image forming apparatus includes: a body of the image forming apparatus; and a cartridge installable with respect to the body, wherein the cartridge includes a developer accommodating portion accommodating a developer; a developing portion supporting a developer holding member holding the developer thereon; and a shutter configured to be movable between an open position at which the shutter opens a communication port and a closed position at which the shutter closes the communication port. The body includes a detecting section detecting a state of the cartridge which changes as the cartridge is used, and a judging section judging whether or not a cartridge exchange timing for exchanging the cartridge has arrived, based on the state of the cartridge detected by the detecting section; and the shutter moves to the closed position under a condition that the judging section judges that the cartridge exchange timing has arrived.

8 Claims, 13 Drawing Sheets

IMAGE FORMING APPARATUS

CROSS REFERENCE TO RELATED APPLICATION

The present application claims priority from Japanese Patent Application No. 2013-227749 filed on Oct. 31, 2013 the disclosure of which is incorporated herein by reference in its entirety.

BACKGROUND

1. Field of the Invention

The present invention relates to an image forming apparatus adopting the electro-photographic system.

2. Description of the Related Art

As an image forming apparatus of the electro-photographic system, there is known an image forming apparatus provided with a photosensitive or photoconductive body on which an electrostatic latent image is formed, and a developing cartridge supplying a toner to the photosensitive body.

As such an image forming apparatus, there is proposed a color laser printer having a toner container accommodating a toner therein, a developing frame having an opening for toner supply via which the toner is allowed to be supplied from the toner container to the developing frame, and a toner seal member sealing the opening of the developing frame (see, for example, Japanese Patent Application Laid-open No. 2002-181157).

In this color laser printer, the toner container accommodating the toner inside thereof is tightly sealed with the toner seal member during, for example, transportation until the developing cartridge is delivered to a user. Further, when the developing cartridge is installed on (attached to) the body of the color laser printer as the image forming apparatus, a take-up shaft provided on the body of the color laser printer is driven so that the toner seal member is taken up or wound up by the take-up shaft. When the toner seal member is taken-up, the opening of the developing frame is opened, thereby allowing the toner to be supplied to the developing roller.

SUMMARY

In the color laser printer described in Japanese Patent Application Laid-open No. 2002-181157, however, the take-up shaft is configured not to be activated again after the toner seal member has been taken up on the take-up shaft.

Therefore, in such a case that a used developing cartridge is collected, etc., there is a fear that any remaining toner inside the developing cartridge might leak out due to any disturbance during transportation of the used developing cartridge.

An object of the present teaching is to provide an image forming apparatus capable of suppressing the leakage of a developer such as a toner from a used cartridge when the used cartridge is collected.

According to an aspect of the present teaching, there is provided an image forming apparatus including: a body of the image forming apparatus; and a cartridge configured to be installed with respect to the body, wherein the cartridge includes: a developer accommodating portion configured to accommodate a developer; a developing portion supporting a developer holding member configured to hold the developer thereon; and a shutter configured to be movable between an open position at which the shutter opens a communication port allowing the developer accommodating portion to communicate with the developing portion and a closed position at which the shutter closes the communication port, the body includes a detecting section configured to detect a state of the cartridge which changes as the cartridge is used; and a judging section configured to judge whether or not a cartridge exchange timing for exchanging the cartridge has arrived, based on the state of the cartridge detected by the detecting section, and the shutter is configured to move to the closed position under a condition that the judging section judges that the cartridge exchange timing has arrived. According to an aspect of the present teaching, there is provided an image forming apparatus including: a body of the image forming apparatus; and a cartridge configured to be installed with respect to the body, wherein the cartridge includes: a developer accommodating portion configured to accommodate a developer; a developing portion supporting a developer holding member configured to hold the developer thereon; and a shutter configured to be movable between an open position at which the shutter opens a communication port allowing the developer accommodating portion to communicate with the developing portion and a closed position at which the shutter closes the communication port, the body includes a detecting section configured to detect a state of the cartridge which changes as the cartridge is used; and a judging section configured to judge whether or not a cartridge exchange timing for exchanging the cartridge has arrived, based on the state of the cartridge detected by the detecting section, and the shutter is configured to move to the closed position under a condition that the judging section judges that the cartridge exchange timing has arrived.

According to such a configuration, it is possible to suppress any flowing of the developer between the developer accommodating portion and the developing portion while the cartridge is (being) exchanged.

Accordingly, even if the developer remains inside the developer accommodating portion when the used cartridge is collected, it is possible to suppress the flowing of the remaining developer which would be otherwise occurred due to, for example, any disturbance during the transportation of the used cartridge, etc.

As a result, it is possible to suppress any leakage of the developer from the used cartridge when the used cartridge is collected.

DESCRIPTION OF THE EMBODIMENTS

<Overall Configuration of Printer>

Figure 1:
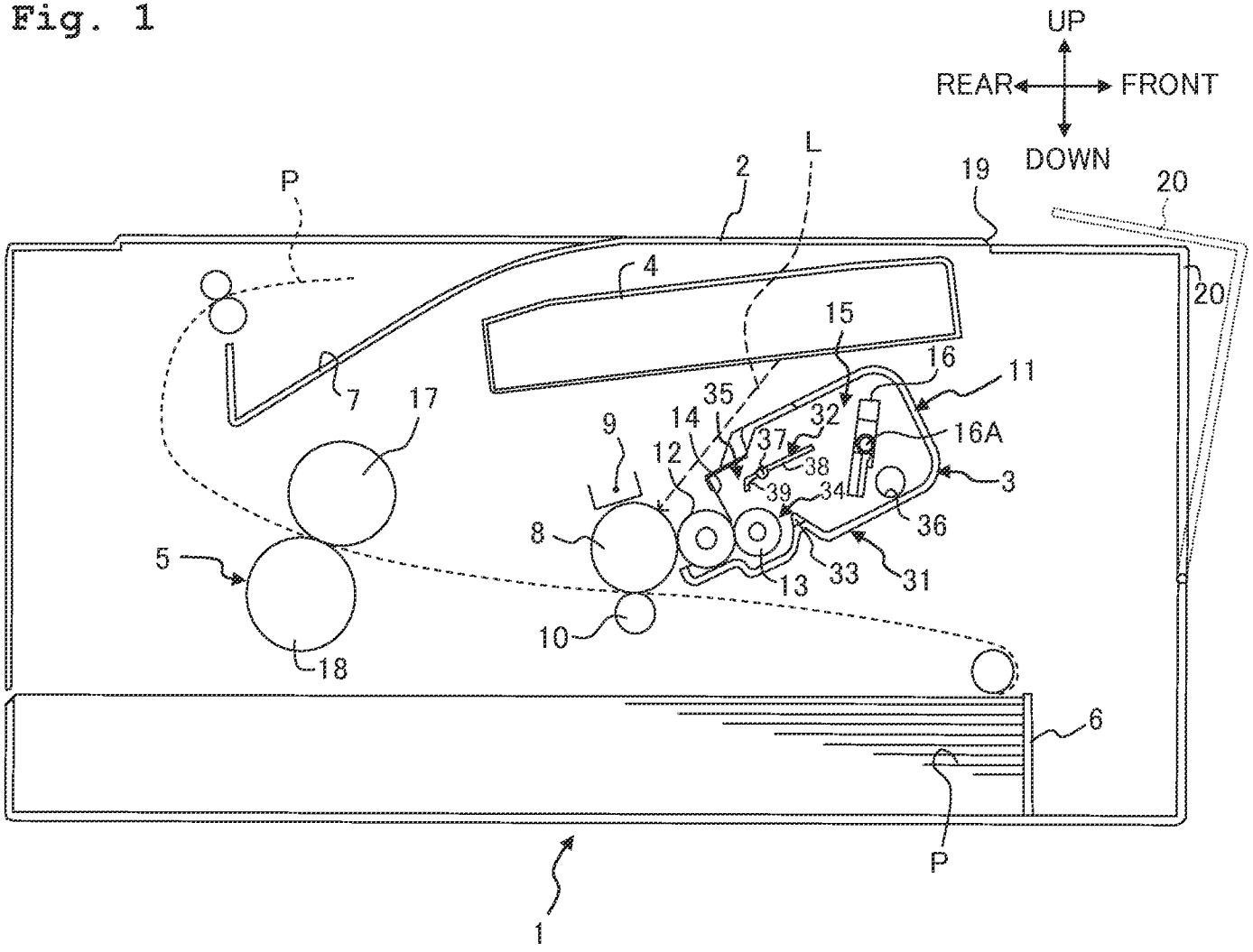
FIG. 1 is a central cross-sectional view of a printer as a first embodiment of the image forming apparatus of the present teaching.

A printer 1 as an example of an image forming apparatus is a monochrome printer of the electro-photographic system, as depicted in FIG. 1. Note that in the following explanation, the up/down direction is defined with reference to a state that the printer 1 is placed horizontally. Namely, a direction toward the upper portion in the sheet surface of FIG. 1 is up direction, and a direction toward the lower portion in the sheet surface of FIG. 1 is down direction. Further, a direction toward the right portion in the sheet surface of FIG. 1 is front direction, and a direction toward the left portion in the sheet surface of FIG. 1 is rear direction. Furthermore, the left/right direction is defined with reference to a state that the printer 1 is viewed from the front. Namely, a direction toward the nearside of the sheet surface of FIG. 1 is left direction, and a direction toward the far side of the sheet surface of FIG. 1 is right direction.

The printer 1 is provided with a body casing 2 as an example of the body of the apparatus (apparatus body), a process unit 3, a scanner unit 4 and a fixing unit 5.

The body casing 2 is formed to have a substantially box-like shape. The body casing 2 has an opening 19, a front cover 20, a feed tray 6, and a discharge tray 7.

The feed tray 6 is arranged at a bottom portion of the body casing 2. The feed tray 6 is configured such that a sheet P (paper P) is placed on the feed tray 6.

The opening 19 is formed at a front end portion of the body casing 2. The opening 19 communicates the inside and the outside of the body casing 2 in the front/rear direction so as to allow the process unit 3 to pass through the opening 19.

The front cover 20 is arranged at the front end portion of the body casing 2. The front cover 20 has a substantially flat plate-like shape extending in the up/down direction. The front cover 20 is pivotably supported by a lower end portion of the front wall of the body casing 2 with a lower end portion thereof as the pivot point. The front cover 20 opens or closes the opening 19.

The discharge tray 7 is arranged at a rear half portion of the upper wall of the body casing 2. The discharge tray 7 is recessed downward from the upper surface of the upper wall of the body casing 2 so that a sheet P is placed on the discharge tray 7.

The process unit 3 is arranged at a substantially central location in the up/down direction of the body casing 2. The process unit 3 is configured to be installable or removable with respect to the body casing 2 via the opening 19. The process unit 3 is provided with a photosensitive drum 8, a scorotron charger 9, a transfer roller 10 and a developing cartridge 11.

The photosensitive drum 8 is supported such that the photosensitive drum 8 is rotatable at a rear end portion of the process unit 3.

The scorotron charger 9 is arranged at a position above the photosensitive drum 8, with a spacing distance from the photosensitive drum 8.

The transfer roller 10 is arranged at a position below the photosensitive drum 8. The transfer roller 10 makes contact with a lower end portion of the photosensitive drum 8.

The developing cartridge 11 is arranged on the front side with respect to the photosensitive drum 8. The developing cartridge 11 is installable or removable with respect to the process unit 3. The developing cartridge 11 is provided with a developing roller 12 as an example of the developer holding member, a supply roller 13, a layer-thickness regulating blade 14, a toner accommodating portion 15 as an example of the developer accommodating portion.

The developing roller 12 is supported by the developing cartridge 11 to be rotatable at a rear end portion of the developing cartridge 11. The developing roller 12 makes contact with a front end portion of the photosensitive drum 8.

The supply roller 13 is supported by the developing cartridge 11 to be rotatable on the front side with respect to the developing roller 12. The supply roller 13 makes contact with a front end portion of the developing roller 12.

The layer-thickness regulating blade 14 is arranged at a position above and in front of the developing roller 12. The layer-thickness regulating blade 14 makes contact with a forward upper portion of the developing roller 12.

The toner accommodating portion 15 is arranged on the front side with respect to the supply roller 13. The toner accommodating portion 15 is configured to accommodate a toner as an example of the developer. The toner accommodating portion 15 is undetachable (unseparable) from the developing cartridge 11. The toner accommodating portion 15 is provided with an agitator 16 as an example of the transporting member.

The agitator 16 is supported by the developing cartridge 11 to be rotatable inside the tonner accommodating portion 15. The agitator 16 is provided with a rotary encoder not depicted in the diagrams.

The scanner unit 4 is arranged to be located above the process unit 3, at an inner upper portion of the body casing 2. The scanner unit 4 is configured to emit laser beam L based on an image data toward the photosensitive drum 8.

The fixing unit 5 is arranged on the rear side with respect to the process unit 3. The fixing unit 5 is provided with a heating roller 17 and a pressing roller 18 which is brought into pressurized contact with a lower end portion of the heating roller 17.

When the printer 1 starts an image forming operation, the scorotron charger 9 uniformly charges the surface of the photosensitive drum 8 and the scanner unit 4 exposes the surface of the photosensitive drum 8. With this, an electrostatic latent image based on an image data is formed on the surface of the photosensitive drum 8.

Further, the agitator 16 agitates the toner inside the toner accommodating portion 15 and supplies the toner to the supply roller 13. The supply roller 13 holds the toner supplied by the agitator 16 thereon, and supplies the toner to the developing roller 12. At this time, the toner is frictionally charged to the positive polarity between the developing roller 12 and the supply roller 13, and is held on the developing roller 12. The layer-thickness regulating blade 14 regulates the thickness of the toner held on the developing roller 12 to a predetermined (constant) thickness.

Then, the toner held on the developing roller 12 is supplied to the electrostatic latent image formed on the surface of the photosensitive drum 8. With this, an image of the toner (toner image) is held on the surface of the photosensitive drum 8.

By the rotation of the respective rollers, sheets P are supplied one by one from the feed tray 6, at a predetermined timing, to a space between the photosensitive drum 8 and the transfer roller 10. The toner image on the surface of the photosensitive drum 8 is transferred onto a sheet P when the sheet P passes between the photosensitive drum 8 and the transfer roller 10.

Then, the sheet P is heated and pressurized when passing between the heating roller 17 and the pressing roller 18. With this, the toner image on the sheet P is thermally fixed on the sheet P. Afterwards, the sheet P is discharged to the discharge tray 7.

<Details of Developing Cartridge>

Figure 2:
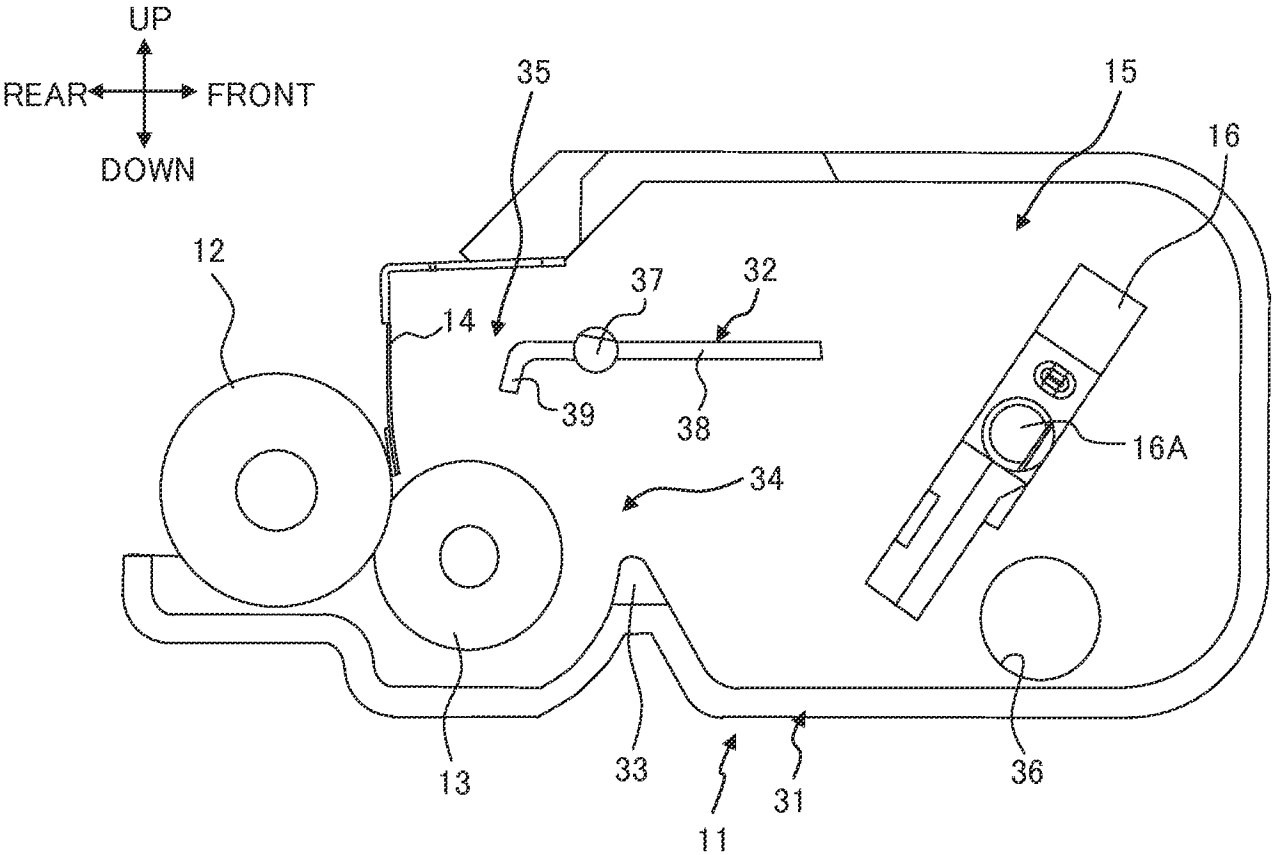
FIG. 2 is a central cross-sectional view of a developing cartridge depicted in FIG. 1.
Figure 3:
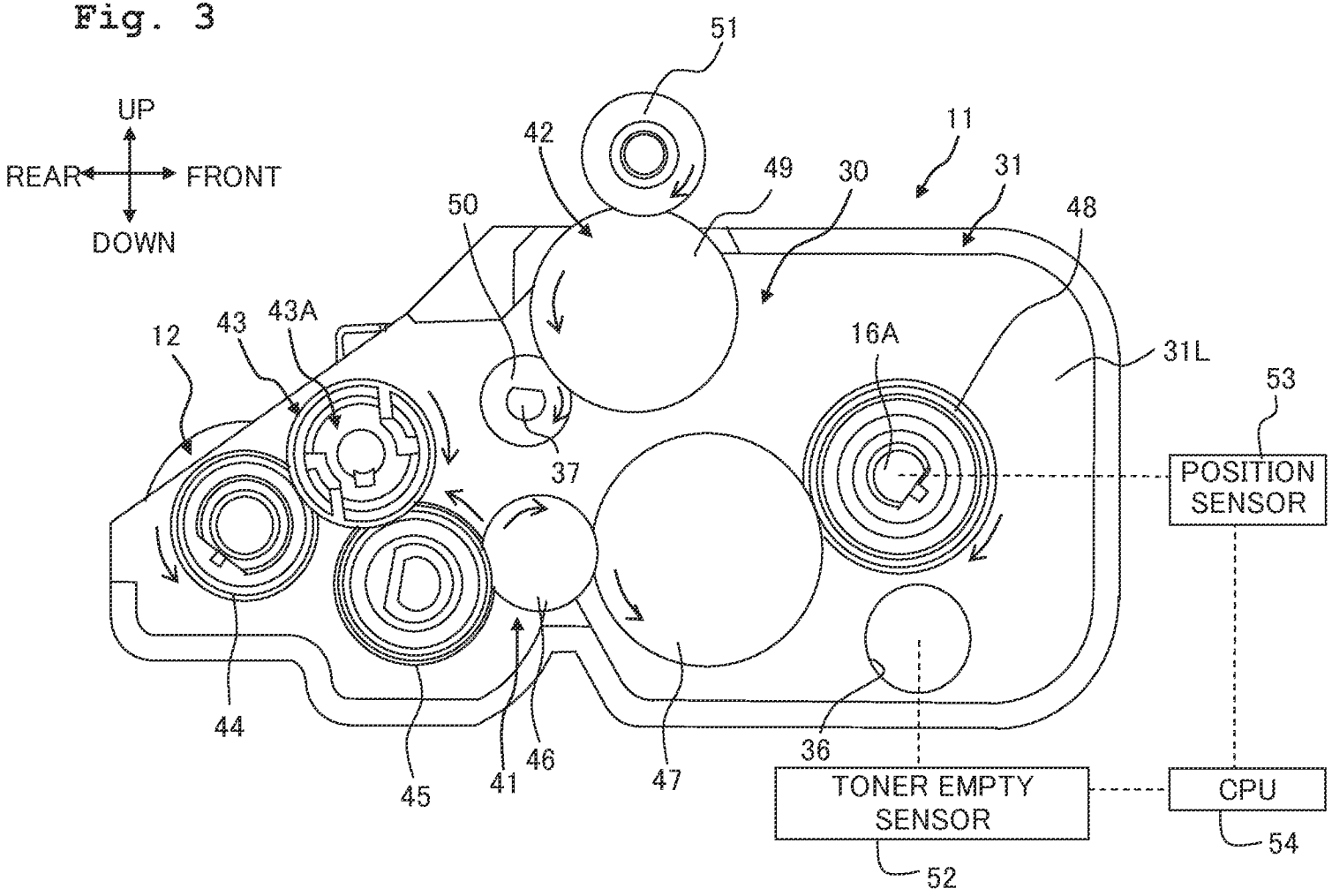
FIG. 3 is a view for explaining a driving unit of the developing cartridge depicted in FIG. 2, while omitting a gear cover for the purpose of clearly depicting first and second gear arrays.

As depicted in FIGS. 2 and 3, the developing cartridge 11 is provided with a developing frame 31 as an example of the casing, a shutter 32 and a driving unit 30.

<Developing Frame>

The developing frame 31 has a substantially box-like shape extending in the left/right direction. The developing frame 31 is provided with a projection 33 and a detection window 36.

The projection 33 projects upward, on the front side with respect to the supply roller 13, from the inner surface of the lower wall of the developing frame 31. The projection 33 has a substantially triangular shape in a cross-sectional view with an upward oriented apex portion. A communication port 34 is defined between the projection 33 and a rear end portion of the upper wall of the developing frame 31. In the developing frame 31, a portion arranged on the front side with respect to the communication port 34 is the toner accommodating portion 15 and a portion arranged on the rear side with respect to the communication port 34 is the developing portion 35. Namely, the developing portion 35 supports the developing roller 12, the supply roller 13 and the layer-thickness regulating blade 14.

One piece of the detection window 36 is arranged at a front lower end portion of each of both side walls in the left/right direction of the developing frame 31. The detection window 36 is formed, for example, of a transparent resin, etc., and has a substantially circular shape in a side view.

<Shutter>

The shutter 32 is arranged inside the communication port 34 to be located above and in front of the supply roller 13. Note that when the reference is made to the direction(s) in the following description of the shutter 32, the explanation will be given with the state depicted in FIG. 2 as the reference. The shutter 32 has a substantially flat plate-like shape extending in the left/right direction. The shutter 32 is pivotable between an open position at which the shutter 32 opens the communication port 34 (see FIG. 2) and a closed position at which the shutter 32 closes the communication port 34 (see FIG. 4). The shutter 32 is provided with a pivot shaft 37, a first open/closed portion 38 and a second open/close portion 39.

The pivot shaft 37 is arranged at an intermediate position in the front/rear direction of the shutter 32. The pivot shaft 37 has a substantially cylindrical shape extending in the left/right direction. Both end portions in the left/right direction of the pivot shaft 37 are rotatably supported by both of the left and right walls of the developing frame 31, respectively, at a position above the projection 33. Note that the left end portion of the pivot shaft 37 penetrates through a left wall 31L of the developing frame 31 such that the left end portion of the pivot shaft 37 is projected leftward from the left wall 31L.

The first open/closed portion 38 has a substantially flat plate-like shape continued from a front end portion of the pivot shaft 37 and projecting frontward.

The second open/closed portion 39 has a substantially flat plate-like shape continued from a rear end portion of the pivot shaft 37, projecting rearward, and a rear end portion of the second open/closed portion 39 is bent downward.

<Driving Unit>

The driving unit 30 is provided with a first gear array 41 and a second gear array 42, as depicted in FIG. 3. Note that the driving unit 30 is provided with a gear cover not depicted in the drawings but configured to cover the first and second gear arrays 41 and 42.

The first gear array 41 is provided with a developing coupling 43, a developing gear 44, a supply gear 45, a first idle gear 46, a second idle gear 47 and an agitator gear 48.

The developing coupling 43 is rotatably supported by a substantially central portion in the front/rear direction of the left wall 31L of the developing frame 31. The developing coupling 43 has a substantially cylindrical shape extending in the left/right direction. The developing coupling 43 has gear teeth along the entire circumference thereof. The developing coupling 43 has a connection recess 43A.

The connection recess 43A is recessed rightward from the left surface of the developing coupling 43, and has a substantially long hole-like shape in a side view which extends in the radial direction of the developing coupling 43.

The developing gear 44 is arranged at a position below and behind the developing coupling 43. The developing gear 44 has a substantially disc-like shape having a thickness in the left/right direction. The developing gear 44 has gear teeth along the entire circumference thereof. The developing gear 44 is supported by a left end portion of the developing roller 12 such that the developing gear 44 cannot rotate relative to the developing roller 12. The developing gear 44 is intermeshed with a lower rear portion of the developing coupling 43.

The supply gear 45 is arranged at a position below and in front of the developing coupling 43. The supply gear 45 has a substantially disc-like shape having a thickness in the left/right direction. The supply gear 45 has gear teeth along the entire circumference thereof. The supply gear 45 is supported by a left end portion of the supply roller 13 such that the supply gear 45 cannot rotate relative to the supply roller 13. The supply gear 45 is intermeshed with a lower front portion of the developing coupling 43.

The first idle gear 46 is arranged at a position in front of the supply gear 45. The first idle gear 46 has a substantially disc-like shape having a thickness in the left/right direction. The first idle gear 46 has gear teeth along the entire circumference thereof. The first idle gear 46 is rotatably supported by the left wall 31L of the developing frame 31. The first idle gear 46 is intermeshed with a front end portion of the supply gear 45.

The second idle gear 47 is arranged at a position in front of the first idle gear 46. The second idle gear 47 has a substantially disc-like shape having a thickness in the left/right direction. The second idle gear 47 has gear teeth along the entire circumference thereof. The second idle gear 47 is rotatably supported by the left wall 31L of the developing frame 31. The second idle gear 47 is intermeshed with a front end portion of the first idle gear 46.

The agitator gear 48 is arranged at a position above and in front of the second idle gear 47. The agitator gear 48 has a substantially disc-like shape having a thickness in the left/right direction. The agitator gear 48 is supported by a left end portion of a rotation axis 16A of the agitator 16 such that the agitator gear 48 cannot rotate relative to the rotation axis 16A. The agitator gear 48 has gear teeth along the entire circumference thereof. The agitator gear 48 is intermeshed with an upper front portion of the second idle gear 47.

The second gear array 42 is provided with a shutter gear 50 and a driving force-input gear 49.

The shutter gear 50 is arranged at a position above and in front of the developing coupling 43, with a spacing distance between the shutter gear 50 and the developing coupling 43. The shutter gear 50 has a substantially disc-like shape having a thickness in the left/right direction. The shutter gear 50 has gear teeth along the entire circumference thereof. The shutter gear 50 is supported by a left end portion of the pivot shaft 37 of the shutter 32 such that the shutter gear 50 cannot rotate relative to the pivot shaft 37.

The driving force-input gear 49 is arranged at a position above and in front of the shutter gear 50. The driving force-input gear 49 has a substantially disc-like shape having a thickness in the left/right direction. The driving force-input gear 49 is rotatably supported by the left wall 31L of the developing frame 31. The driving force-input gear 49 has gear teeth along the entire circumference thereof. The driving force-input gear 49 is intermeshed with an upper front portion of the shutter gear 50. An upper end portion of the driving force-input gear 49 is protruded upward beyond the upper surface of the developing frame 31.

<Configuration of Body Casing>

The body casing 2 is provided with a driving force-transmitting gear 51, a toner empty sensor 52 as an example of the detecting section, a position sensor 53 as an example of the position detecting section, and a CPU 54 as an example of the judging section and as an example of the controller.

The driving force-transmitting gear 51 as an example of the shutter driving section is arranged at a position above the developing cartridge 11. When the developing cartridge 11 is installed on the body casing 2, the driving force-transmitting gear 51 is intermeshed with an upper end portion of the driving force-input gear 49 of the developing cartridge 11.

The toner empty sensor 52 is an optical sensor and is provided with a light-emitting portion configured to emit a detection light and a light-receiving portion configured to receive the detection light, wherein the light-emitting portion and the light-receiving portion are arranged so as to sandwich the developing cartridge 11 therebetween, while facing each other via the detection windows 36. The toner empty sensor 52 outputs a detection signal in a case that the light-receiving portion receives the detection light (sensor: ON), but does not output the detection signal in a case that the light-receiving portion does not receive the detection light (sensor: OFF).

The position sensor 53 is an optical sensor and is provided with a light-emitting portion configured to emit a detection light, and a light-receiving portion configured to receive the detection light, wherein the light-emitting portion and the light-receiving portion are arranged so as to sandwich a slit disc, of the rotary encoder (not depicted) of the agitator 16, therebetween. The position sensor 53 outputs a detection signal in a case that the light-receiving portion receives the detection light (sensor: ON), but does not output the detection signal in a case that the light-receiving portion does not receive the detection light (sensor: OFF).

The CPU 54 is electrically connected to the toner empty sensor 52 and the position sensor 53. The CPU 54 receives the detection signals from the toner empty sensor 52 and the position sensor 53, respectively.

<Image Forming Operation>

In order to execute the image forming operation as described above, an unused developing cartridge 11 is installed on the body casing 2. At this time, the shutter 32 is located at the open position, as depicted in FIG. 1.

Then, the image forming operation is executed, the amount of the toner inside the toner accommodating portion 15 is decreased, and the level of the toner is located below the detection windows 36. In such a case, the detection light emitted from the light-emitting portion of the toner empty sensor 52 passes through the detection windows 36 and is detected by the light-receiving portion of the toner empty sensor 52, which in turn causes the toner empty sensor 52 to output the detection signal (sensor: ON).

This causes the CPU 54 to judge that the level of the toner is located at a position below the detection windows 36, and to judge that the exchange timing for the developing cartridge 11 has arrived (that the developing cartridge is to be exchanged).

Next, the CPU 54 calculates or infers the position of the agitator 16 based on the detection signal from the position sensor 53. In a case that the detected position of the agitator 16 is a non-interfering position at which the agitator does not interfere with the shutter 32, the CPU 54 releases the input of driving force to the developing coupling 43 to thereby stop the rotation of the agitator 16.

Afterwards, the CPU 54 drives the driving force-transmitting gear 51 of the body casing 2 to rotate clockwise as seen from the left side surface, as depicted in FIG. 3.

With this, the driving force is transmitted to the shutter gear 50 via the driving force-input gear 49 of the developing cartridge 11, thereby causing the shutter 32 to pivot from the open position to the closed position.

Figure 4:
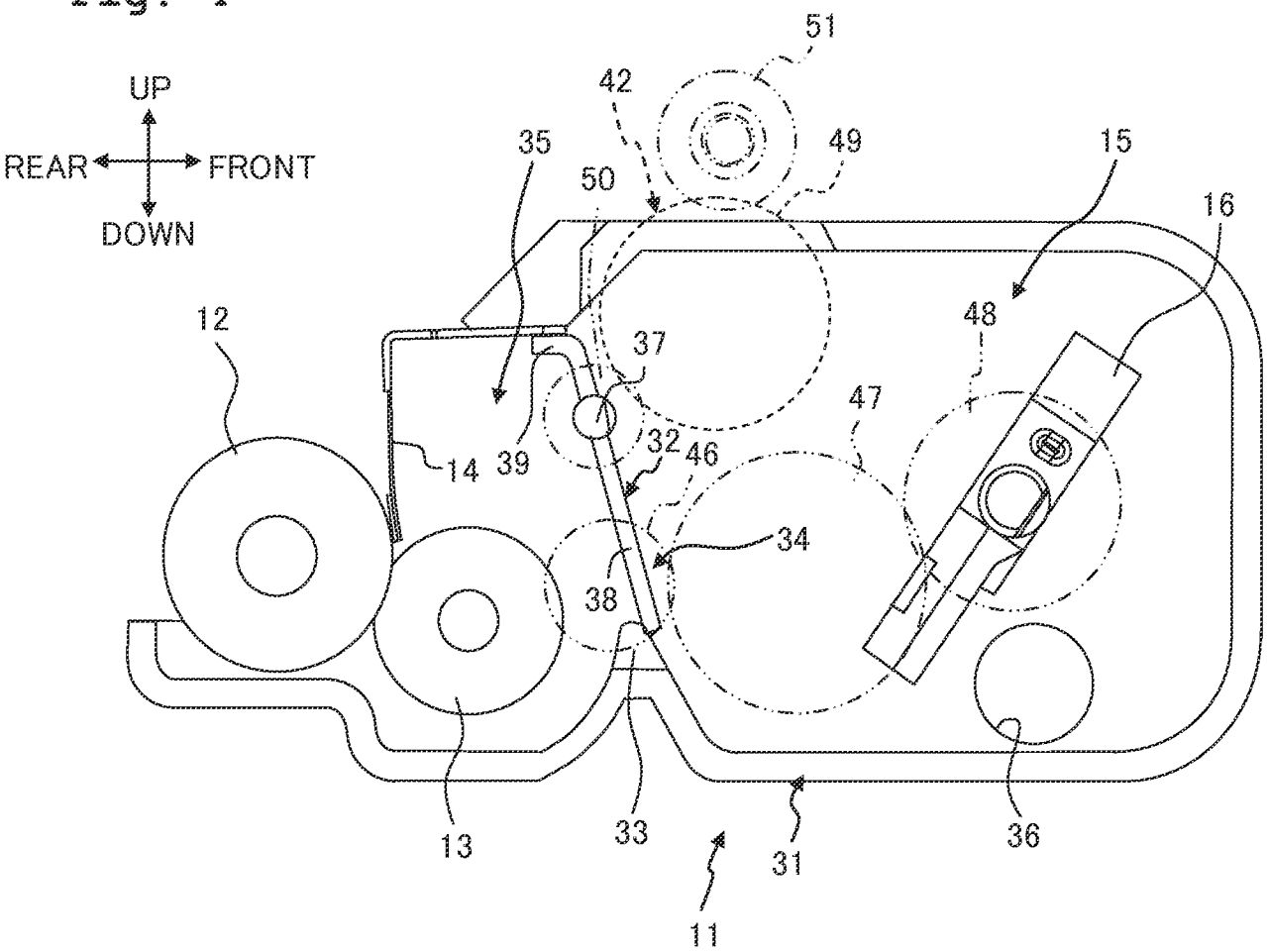
FIG. 4 is a view for explaining a pivot motion (rocking motion) of a shutter depicted in FIG. 2 from an open position to a closed position, depicting a state that the shutter is located at the closed position.

Then, when the shutter 32 is located at the closed position as depicted in FIG. 4, the CPU 54 stops the driving force-transmitting gear 51 of the body casing 2.

[Function and Effect]

According to the printer 1, it is possible to suppress the flowing of the toner between the toner accommodating portion 15 and the developing portion 35 as depicted in FIG. 4, in a case that the developing cartridge 11 is (being) exchanged.

Accordingly, even if the toner remains inside the toner accommodating portion 15 when the used developing cartridge 11 is collected, it is possible to suppress any flowing of the toner due to, for example, the disturbance during the transportation of the used developing cartridge 11.

As a result, it is possible to suppress any leakage of the toner from the used developing cartridge 11 when the used developing cartridge 11 is collected.

Further, according to the printer 1, in a case that the exchange timing has arrived for the developing cartridge 11, the shutter 32 is located at the closed position in a state that the developing cartridge 11 is installed inside the body casing 2.

Accordingly, it is possible to suppress the leakage of the toner from the developing cartridge 11, even in such a case that the exchange timing has arrived for the developing cartridge 11 and then the body casing 2 is transported in a state that the developing cartridge 11 is installed on the body casing 2.

According to the printer 1, as depicted in FIG. 3, the CPU 54 judges the exchange timing for the developing cartridge 11 based on the level of the toner detected by the toner empty sensor 52, namely based on the result of detection of the amount of the toner.

Accordingly, when the amount of the toner inside the toner accommodating portion 15 becomes small, the developing cartridge 11 can be exchanged.

As a result, it is possible to suppress the leakage of the toner, adhered to the inside of the used developing cartridge 11, from the used developing cartridge 11 more assuredly when the used developing cartridge 11 is collected.

According to the printer 1, the shutter 32 moves to the closed position under a condition that the position of the agitator 16 detected by the positon sensor 53 is the non-interfering position at which the agitator 16 does not interfere with the shutter 32.

Accordingly, it is possible to prevent the shutter 32 from interfering with the agitator 16, and to cause the shutter 32 to be located at the closed position in an assured manner.

According to the printer 1, the shutter 32 pivots between the open position and the closed position, as depicted in FIGS. 2 and 4.

Thus, the shutter 32 can be moved from the open position to the closed position with a simple configuration.

According to the printer 1, the shutter 32 is located at the open position as depicted in FIG. 2, in a case that the developing cartridge 11 is unused.

Accordingly, it is possible to execute the image forming operation in an assured manner when an unused developing cartridge 11 is installed on the body casing 2.

In a case that a manufacturer ships an unused developing cartridge 11, any reliable packing of the developing cartridge 11 is guaranteed by the manufacturer; on the other hand, in a case that the manufacturer collects a developing cartridge 11 for which the exchanging timing has arrived, the developing cartridge 11 is packed by the user, thus leading to a possibility that the packaging of the developing cartridge 11 by the user might be unsufficient.

However, according to the printer 1, the communication port 34 is opened at the time of shipment when the developing cartridge 11 is unused and the reliable packaging for the developing cartridge 11 is guaranteed; and the communication port 34 can be closed at the time of collection when the exchange timing for the developing cartridge 11 has arrived and when there is a fear that the packaging of the developing cartridge 11 might be unsufficient.

Accordingly, it is sufficient that a configuration for activating the shutter 32 at a necessary timing is provided on the body casing 2, thereby making it possible to simplify the configuration of the body casing 2.

[Second Embodiment]

In the following, a second embodiment of the printer will be explained with reference to FIGS. 5 to 8. Note that in the second embodiment, regarding configuration same as or similar to that of the above-described first embodiment, same or similar reference numerals are assigned to parts or components same as or similar to those of the first embodiment, and any explanation therefor will be omitted.

<Outline of Second Embodiment>

In the first embodiment described above, the driving force is inputted to the shutter 32 by the second gear array 42, which is independent of the first gear array 41 for inputting the driving force to the agitator 16.

Figure 5:
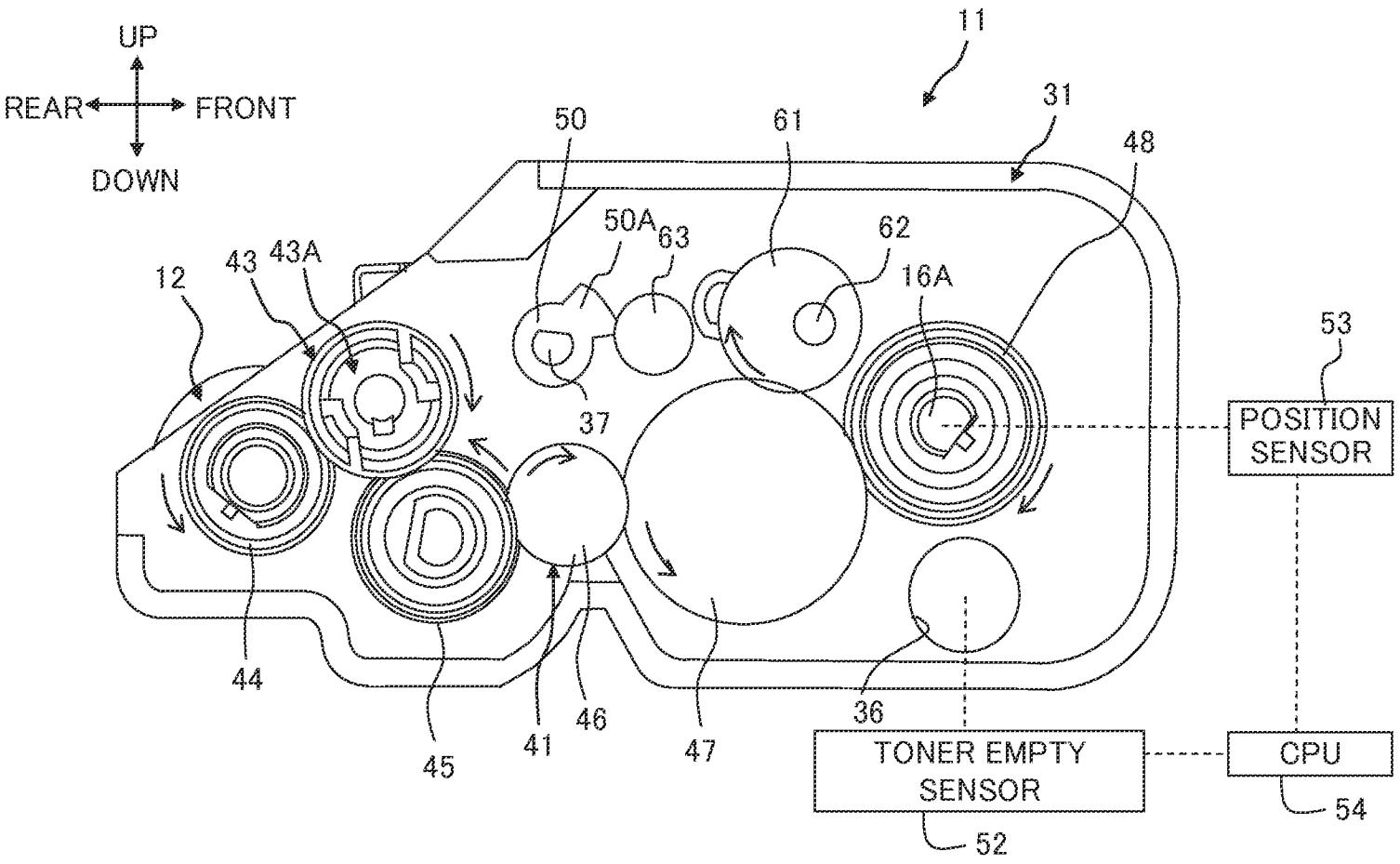
FIG. 5 is a view for explaining a driving unit of a developing cartridge according to a second embodiment, while omitting a gear cover for the purpose of clearly depicting a first gear array, a revolution gear, a third idle gear and a shutter gear.

On the other hand, in the second embodiment, the driving force is inputted to the shutter 32 by a revolution gear 61 which revolves (rotates) around a second idle gear 47, as depicted in FIG. 5. Note that also in the second embodiment, the driving unit 30 is provided with a gear cover (not depicted).

<Configuration of Second Embodiment>

As depicted in FIG. 5, a shutter gear 50 in the second embodiment is a partially toothed gear (tooth-lacking gear) having a gear tooth 50A only at a front end portion thereof.

The developing cartridge 11 is provided with the revolution gear 61 and a third idle gear 63.

The revolution gear 61 is arranged at a position above and in front of the second idle gear 47. The revolution gear 61 has a substantially disc-like shape having a thickness in the left/right direction. The revolution gear 61 has gear teeth along the entire circumference thereof. The revolution gear 61 is supported by the left wall 31L of the developing frame 31 such that the revolution gear 61 is rotatable and is movable along the circumferential direction of the second idle gear 47. The revolution gear 61 is intermeshed with an upper end portion of the second idle gear 47. The revolution gear 61 is movable between a separate position at which the revolution gear 61 is located to be separate from and in front of the third idle gear 63 with a spacing distance (see FIG. 6) and an intermeshing position at which the revolution gear 61 is intermeshed with the third idle gear 63 (see FIG. 7). In a case that the developing cartridge 11 is unused, the revolution gear 61 is located at the separate position.

The third idle gear 63 is arranged between the shutter gear 50 and the revolution gear 61. The third idle gear 63 has a substantially disc-like shape having a thickness in the left/right direction. The third idle gear 63 has gear teeth along the entire circumference thereof. The third idle gear 63 is intermeshed with the gear tooth 50A of the shutter gear 50.

Figure 6:
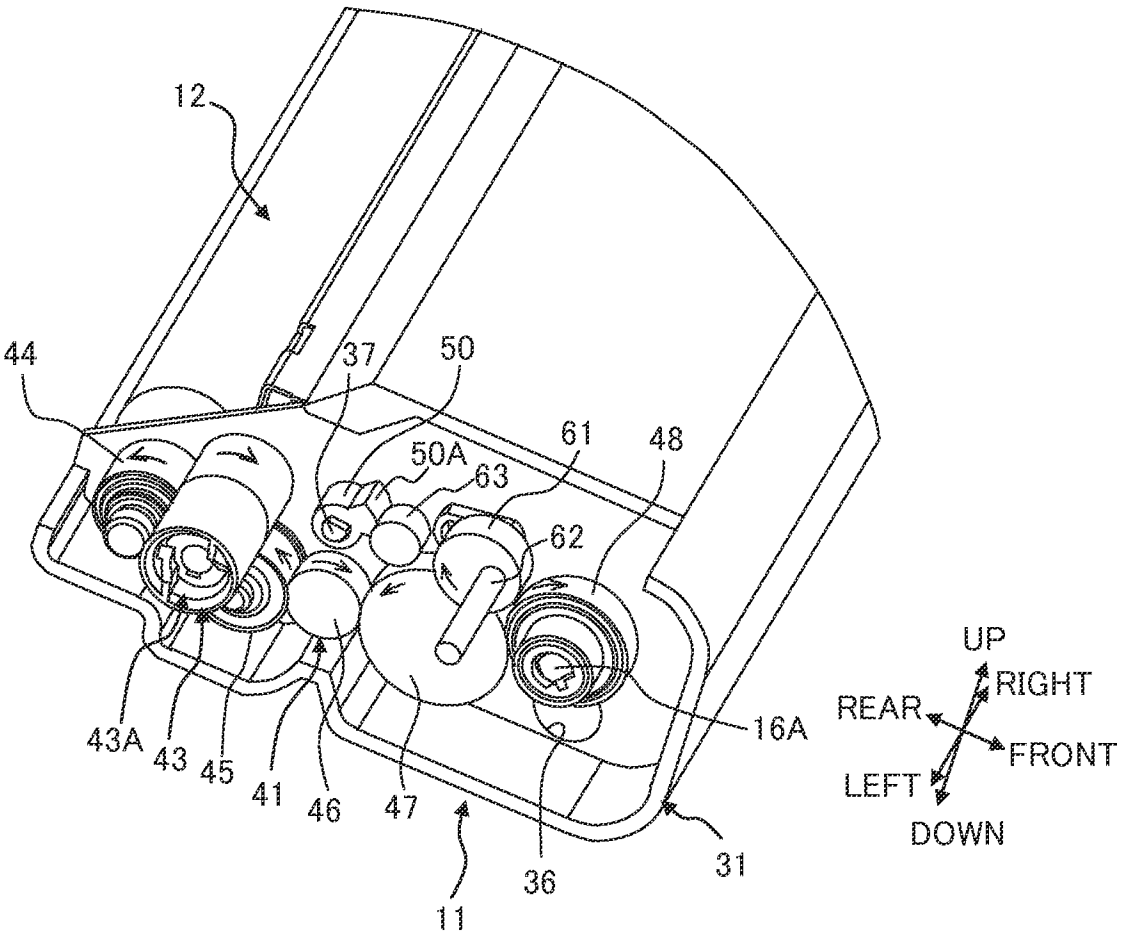
FIG. 6 is a view for explaining the driving of the shutter gear depicted in FIG. 5, depicting a state that the revolution gear is located at a separate position, while omitting the gear cover for the purpose of clearly depicting the first gear array, the revolution gear, the third idle gear and the shutter gear.

The body casing 2 is provided with a regulating member 62, as depicted in FIG. 6.

The regulating member 62 is arranged on the left side in the developing cartridge 11. The regulating member 62 has a substantially cylindrical shape extending in the left/right direction. The regulating member 62 is capable of advancing to a contact position at which the regulating member 62 makes contact with the revolution gear 61 (see FIG. 6) and retracting to a retract position at which the regulating member 62 is retracted leftward from the contact position (not depicted in the drawings).

<Shutter-Closing Operation in Second Embodiment>

When the above-described image forming operation is executed, each of the gears of the first gear array 41 is rotated in one of the directions indicated by arrows in the FIG. 6, and the revolution gear 61 is rotated clockwise as seen from the left side. Here, the revolution gear 61 is located at the separate position due to the friction between the revolution gear 61 and the left wall 31L of the developing frame 31 while easily receiving and parrying the rotational moment received from the second idle gear 47 by the rotation of the revolution gear 61 itself, in other words, while converting the rotational moment received from the second idle gear 47 into the rotational movement of the revolution gear 61 itself.

Further, in a case that the CPU 54 judges that the exchange timing for exchanging the developing cartridge 11 has arrived, the CPU 54 causes the regulating member 62 to move to the contact position, as depicted in FIG. 6.

Then, the rotation of the revolution gear 61 is regulated by the friction between the regulating member 62 and the revolution gear 61. This causes the revolution gear 61 to move from the separation position to the contact position, due to the rotating moment received from the second idle gear 47, and to be intermeshed with the third idle gear 63, as depicted in FIG. 7.

Figure 7:
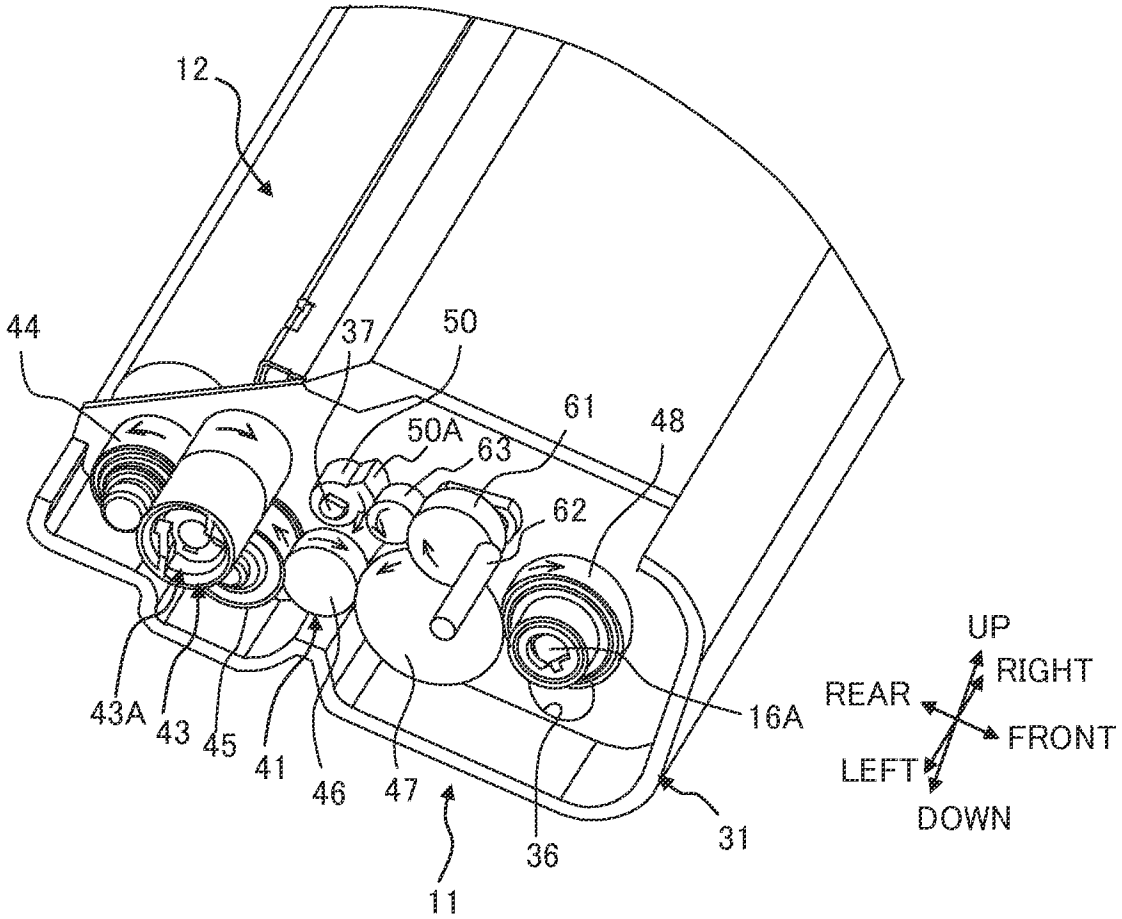
FIG. 7 is a view for explaining the driving of the shutter gear, following FIG. 6 and depicting a state that the revolution gear is located at an intermeshing positon and intermeshed with the shutter gear, while omitting the gear cover for the purpose of clearly depicting the first gear array, the revolution gear, the third idle gear and the shutter gear.
Figure 8:
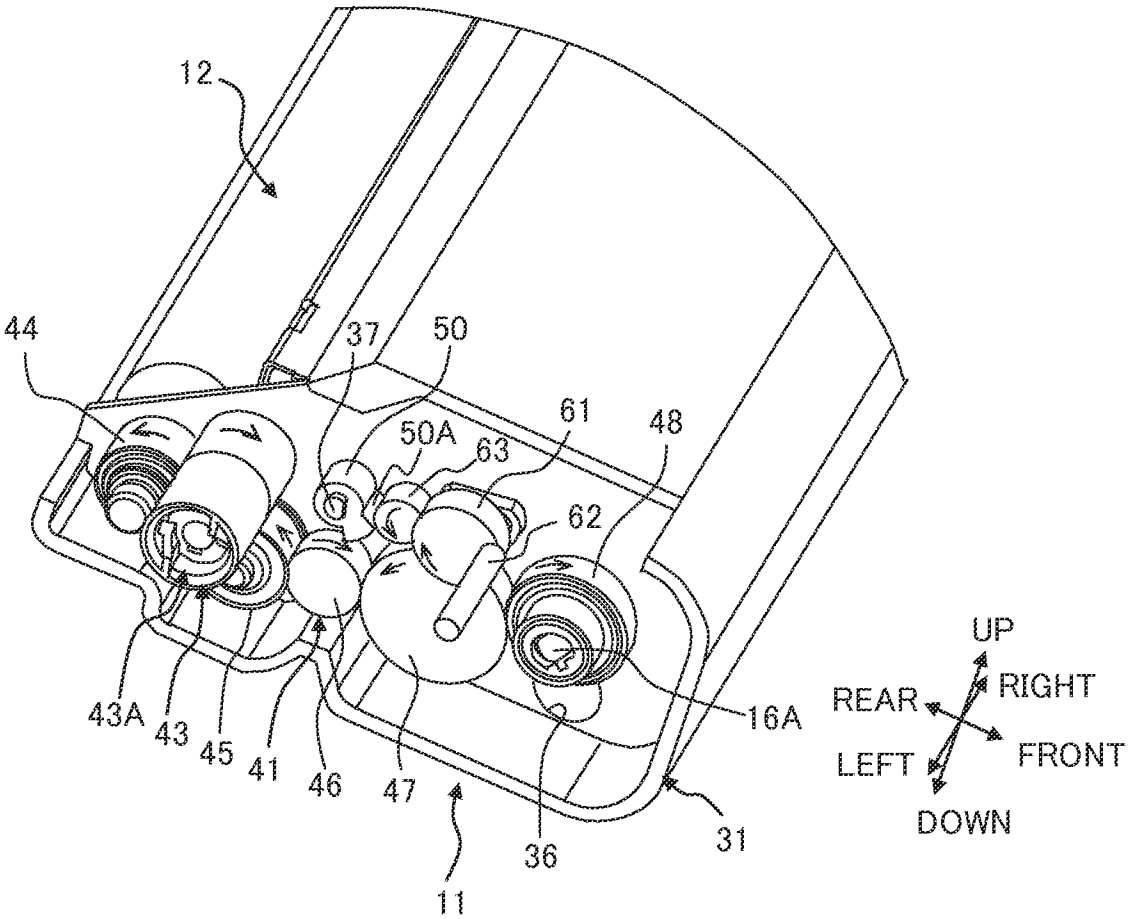
FIG. 8 is a view for explaining the driving of the shutter gear, following FIG. 7 and depicting a state that the shutter gear is separated from the revolution gear in a downward direction, while omitting the gear cover for the purpose of clearly depicting the first gear array, the revolution gear, the third idle gear and the shutter gear.

Then, the driving force is transmitted to the shutter gear 50 via the third idle gear 63, thereby causing the pivot shaft 37 of the shutter 32 to rotate from the state depicted in FIG. 7 to a state depicted in FIG. 8, which in turn causes the shutter 32 to pivot from the open position to the closed position.

Then, when the shutter 32 is located at the closed position, the gear tooth 50A of the shutter gear 50 is moved downward to be separated from the third idle gear 63, thereby releasing the transmission of the driving force to the shutter gear 50.

[Function and Effect in Second Embodiment]

Also in the second embodiment, the effects similar to those obtainable by the above-described first embodiment can be obtained.

[Third Embodiment]

In the following, a third embodiment of the printer will be explained with reference to FIGS. 9 to 13. Note that in the third embodiment, regarding configuration same as or similar to that of the above-described first embodiment, same or similar reference numerals are assigned to parts or components same as or similar to those of the first embodiment, and any explanation therefor will be omitted.

<Outline of Third Embodiment>

In the first embodiment described above, the driving force is inputted to the shutter 32 by the second gear array 42, which is independent of the first gear array 41 for inputting the driving force to the agitator 16.

Figure 10:
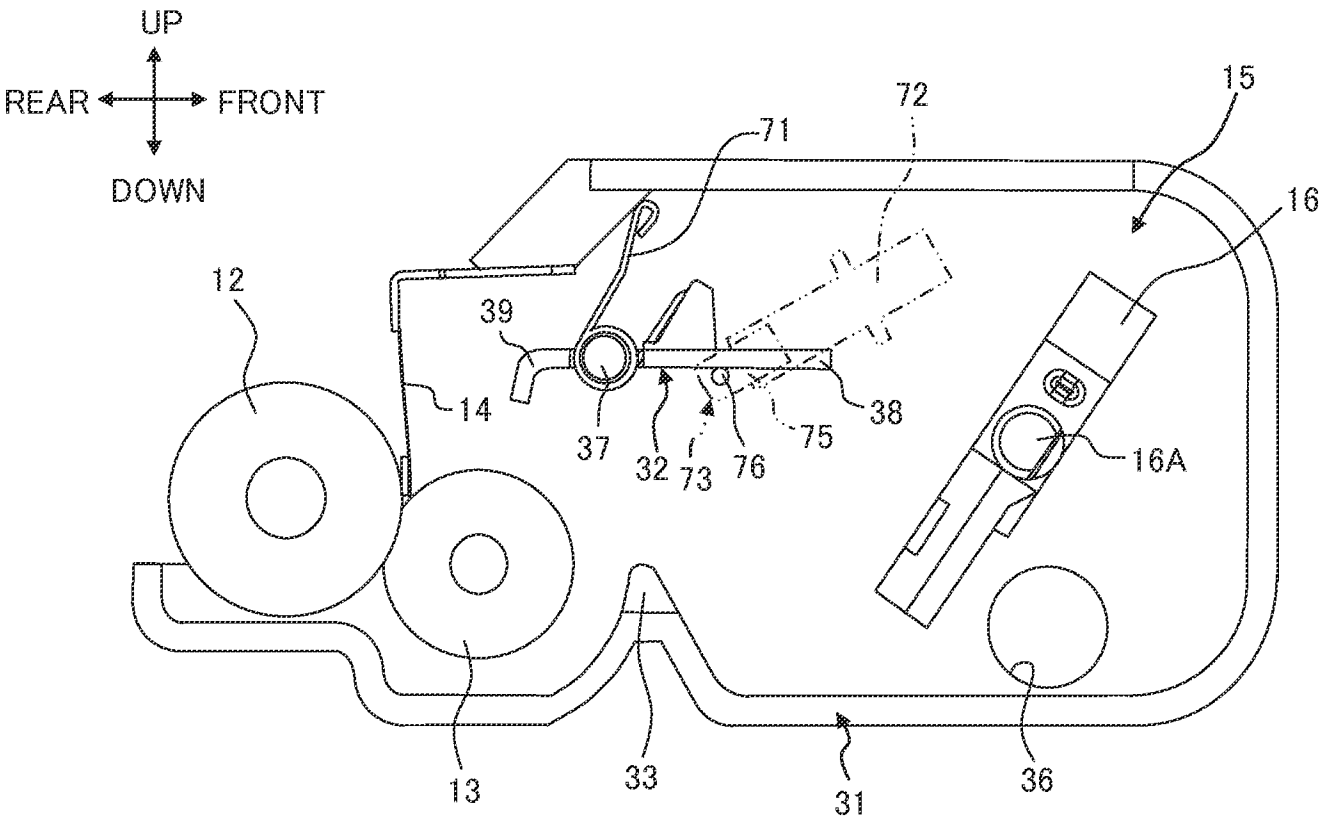
FIG. 10 is a central cross-sectional view of the developing cartridge depicted in FIG. 9.
Figure 11:
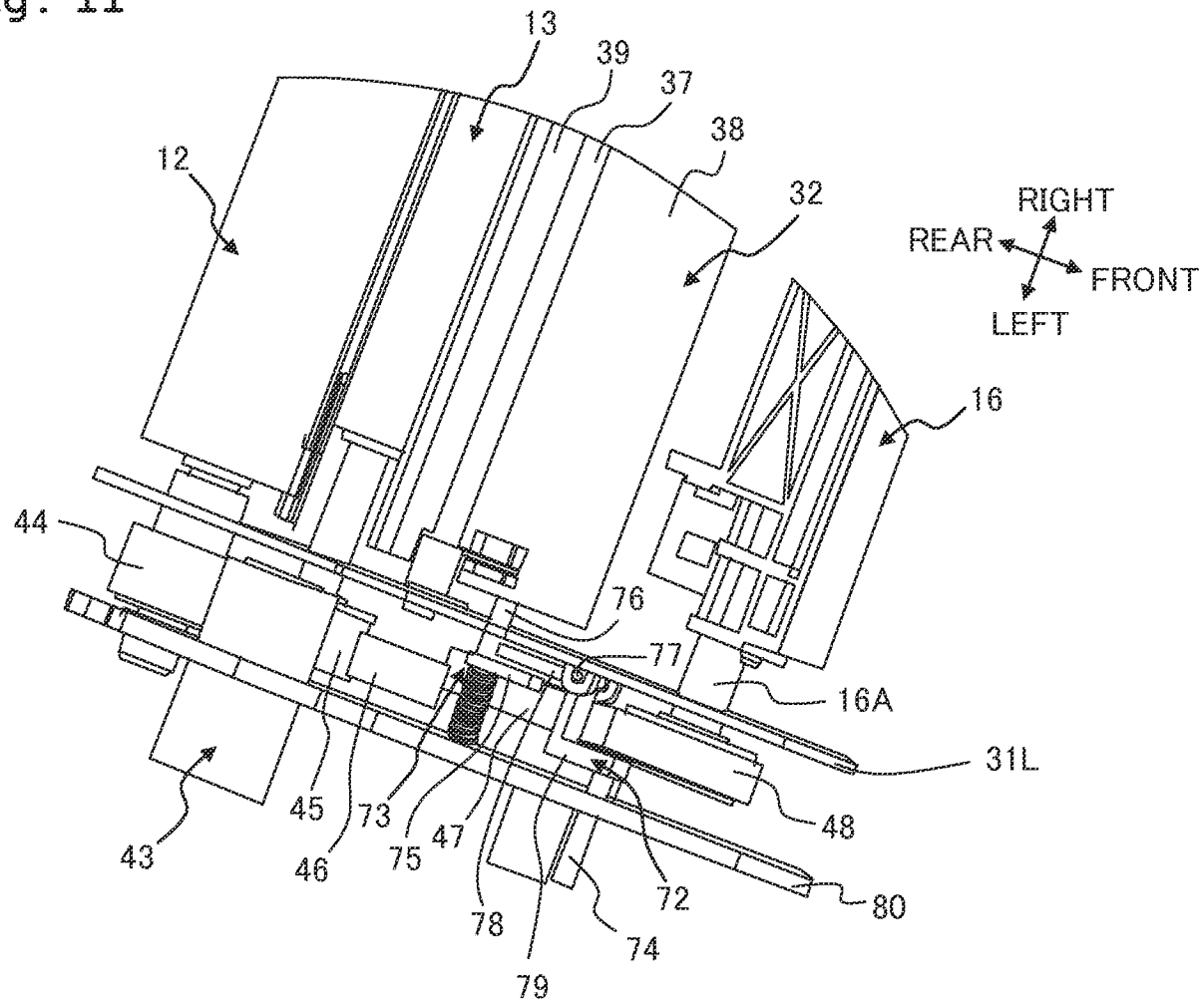
FIG. 11 is a view for explaining a linking member and a regulating member of the developing cartridge depicted in FIG. 9.

In the third embodiment, on the other hand, the urging force of a coil spring 71 causes the shutter 32 to move toward the closed position, as depicted in FIGS. 10 and 11.

<Configuration of Third Embodiment>

Figure 9:
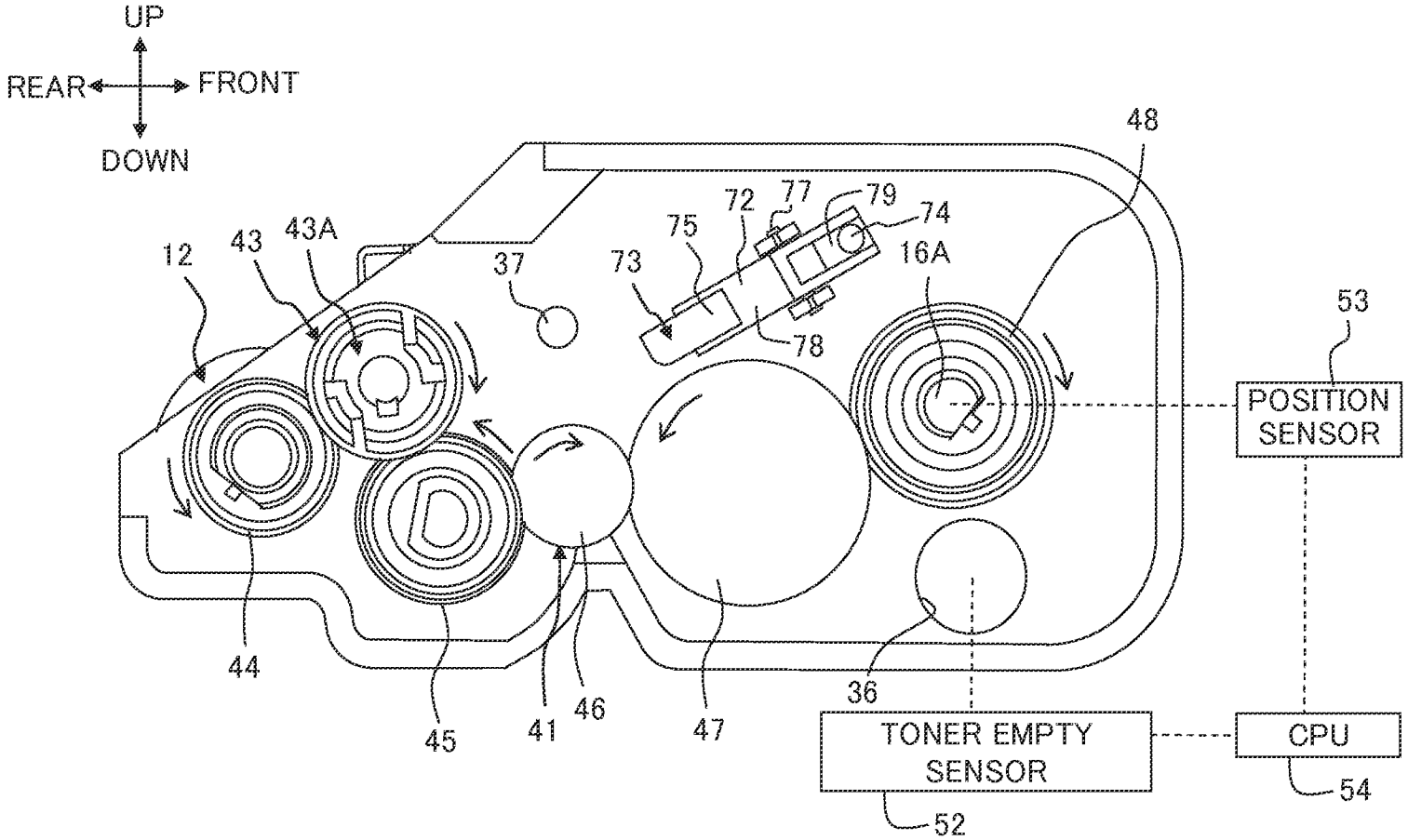
FIG. 9 is a view for explaining a driving unit of a developing cartridge according to a third embodiment.

As depicted in FIGS. 9 and 10, the developing cartridge 11 of the third embodiment does not have the second gear array 42, but is provide instead with the coil spring 71, a linking member 72, a regulating member 73 and a gear cover 80.

The coil spring 71 is wound around the pivot shaft 37 of the shutter 32. One end portion of the coil spring 71 is locked on the upper surface of the first open/closed portion 38 of the shutter 32, and the other end portion of the coil spring 71 is locked on the upper wall of the developing frame 31. With this, the coil spring 71 urges the shutter 32 always toward the closed position in the clockwise direction as seen from the left side.

The linking member 72 is arranged on the left side with respect to the left wall 31L of the developing frame 31, on the front side with respect to the shutter 32, as depicted in FIG. 11. The linking member 72 has a pivot shaft 77, an engaging portion 78 and a pressed portion 79.

The pivot shaft 77 is arranged at a substantially central portion in the front/rear direction of the linking member 72. The pivot shaft 77 has a substantially cylindrical shape extending in a frontward and downward direction. The pivot shaft 77 is pivotably supported by the left surface of the left wall 31L of the developing frame 31.

The engaging portion 78 has a substantially flat plate-like shape extending from the pivot shaft 77 in a rearward and downward direction.

The pressed portion 79 has a shape of a bent plate extending leftward from the pivot shaft 77 and bending at a left end portion of the pressed portion 79, and further extending frontward and upward.

The regulating member 73 is arranged below and behind the liking member 72 such that the regulating member 73 is located on the left side with respect to the left wall 31L of the developing frame 31. The regulating member 73 is provided with a regulating portion 76 and an engaging portion 75.

The regulating portion 76 has a substantially cylindrical shape extending in the left/right direction. The regulating portion 76 penetrates through the left wall 31L of the developing frame 31. A right end portion of the regulating portion 76 makes contact with the lower surface of the first open/closed portion 38 of the shutter 32 at the open position.

The engaging portion 75 has a substantially flat plate-like shape continued from a left end portion of the regulating portion 76 and extending frontward and upward. The engaging portion 75 faces the left side of the rear portion of the engaging portion 78 of the linking member 72.

The gear cover 80 is arranged on the left side with respect to the developing frame 31. The gear cover 80 covers the first gear array 41, the linking member 72 and the regulating member 73. Note that the gear cover 80 has a through hole (not depicted) configured to receive a pressing member 74 (to be described below).

The body casing 2 is provided with the pressing member 74.

The pressing member 74 is arranged on the left side with respect to the developing cartridge 11. The pressing member 74 has a substantially cylindrical shape extending in the left/right direction. The pressing member 74 is capable of advancing to a pressing position at which the pressing member 74 presses the pressed portion 79 of the linking member 72 (see FIG. 12) and retracting to a retract position at which the pressing member 74 is retracted leftward from the pressing position (see FIG. 11).

<Shutter-Closing Operation in Third Embodiment>

In a case that the CPU 54 judges that the exchange timing for exchanging the developing cartridge 11 has arrived, the CPU 54 causes the pressing member 74 to move to the pressing position.

Figure 12:
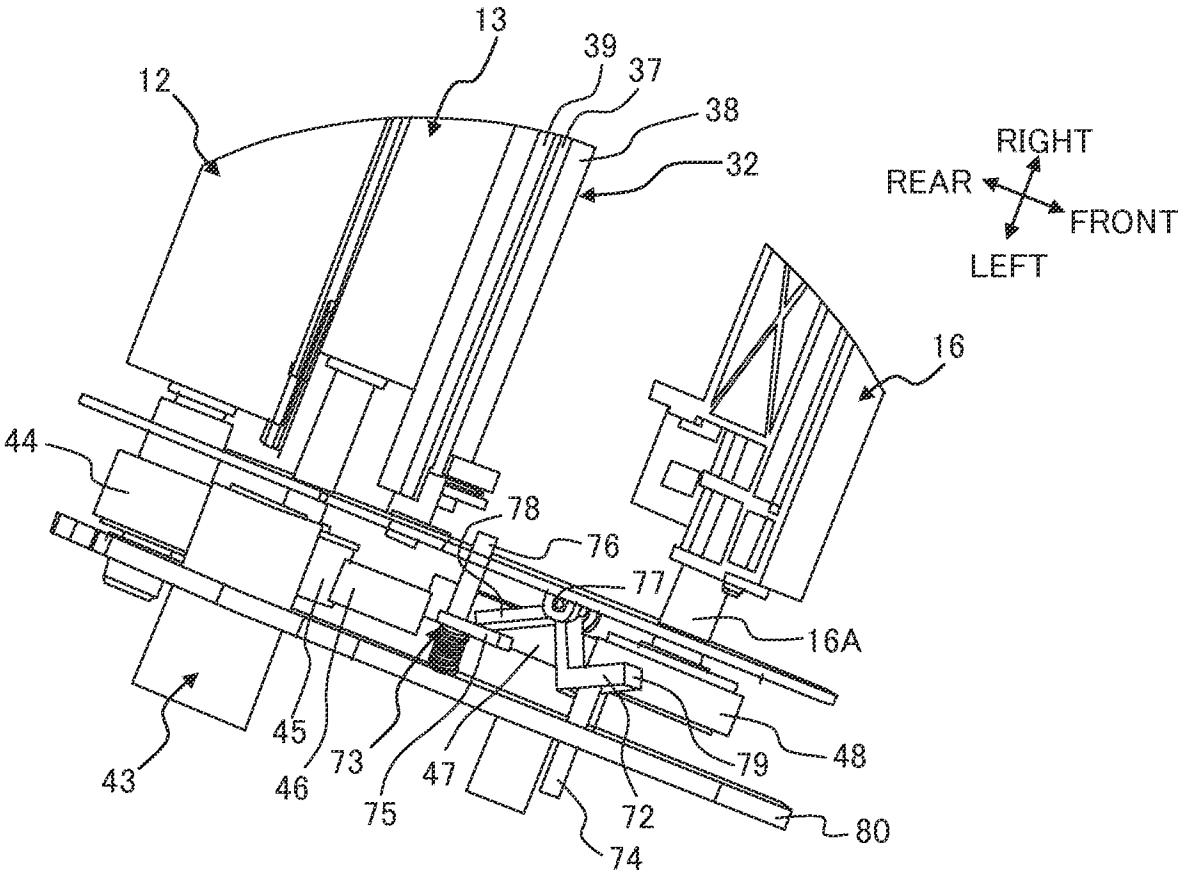
FIG. 12 is a view for explaining the operations of the linking member and regulating member depicted in FIG. 11.

Then, the linking member 72 is pressed by the pressing member 74 and caused to pivot such that the rear end portion of the engaging portion 78 is moved leftward, as depicted in FIG. 12.

Then, the regulating member 73 is pressed leftward by the engaging portion 78 of the linking member 72 and is moved leftward, which in turn makes the regulating member 76 move leftward and separate from the first open/closed portion 38 of the shutter 32.

Figure 13:
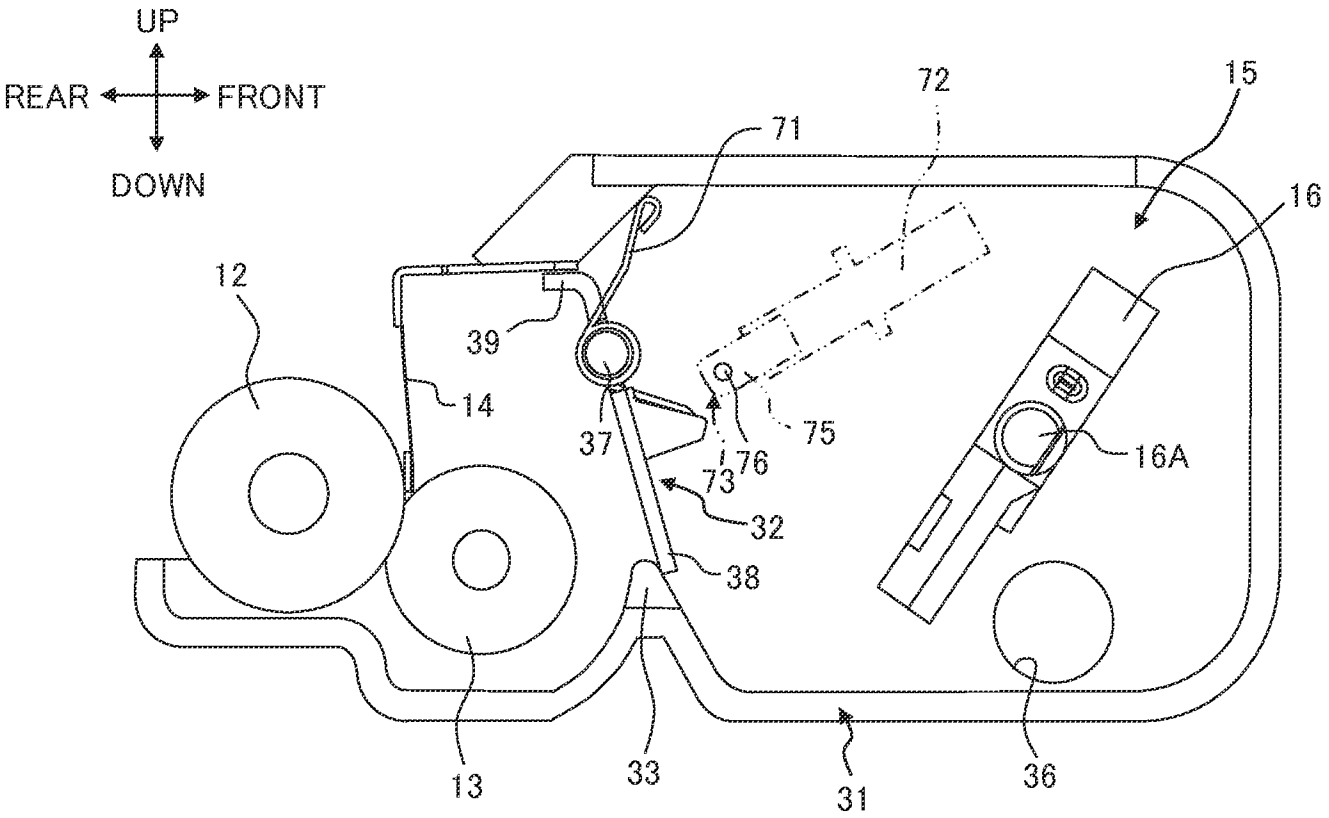
FIG. 13 is a view for explaining a pivot motion of a shutter depicted in FIG. 10 from an open position to a closed position, depicting a state that the shutter is located at the close position.

As a result, the contact between the regulating portion 76 and the first open/closed portion 38 of the shutter 32 is released, thereby causing the shutter 32 to pivot from the open position to the closed positon due to the urging force of the coil spring 71, as depicted in FIG. 13.

[Function and Effect in Third Embodiment]

Also in the third embodiment, the effects similar to those obtainable by the above-described first embodiment can be obtained.

[Modifications]

In the first embodiment, the CPU 54 judges the exchange timing for the developing cartridge 11 based on the level of the toner detected by the toner empty sensor 52, namely based on the detection result of the amount of the toner. However, the criterion of the judgment for the exchange timing is not limited to the amount of the toner. For example, it is also possible to judge the exchange timing for the developing cartridge 11 based on the number of dots of a print pattern, the rotation number of the developing roller, a charge amount of the toner, etc. In a case that the judgment is made based on the number of dots of the print pattern, it is allowable that the remaining amount of the toner is estimated or presumed based on the number of dots of the print pattern and the exchange timing for the developing cartridge 11 is judged. In a case that the judgment is made based on the rotation number of the developing roller or the charge amount of the toner, it is allowable that the degradation of the toner is estimated or presumed based on the rotation number of the developing roller or the charge amount of the toner and the exchange timing for the developing cartridge 11 is judged.

In the first embodiment described above, it is also allowable to move the shutter 32 between the open position and an intermediate position, which is located between the open and closed positions, under a condition that an image forming operation is being executed.

According to this modification, the shutter 32 is not located at the closed position while the image forming operation is being executed, thereby making it possible to supply the toner from the toner accommodating portion 15 to the developing portion 35 in an ensured manner.

Further, by moving the shutter 32 between the open position and the intermediate portion while the image forming operation is being executed, it is also possible to agitate the toner inside the developing cartridge 11.

A cartridge according to the present teaching includes a drum unit provided with the photosensitive drum 8 and the developing cartridge 11 as an integrated body.

Further, although the above-described developing roller 12 is an example of the developer agent holding member, the developer holding member includes a developing sleeve, a developing belt, a brush-shaped roller, etc., in addition to the developing roller 12.

What is claimed is:

1. An image forming apparatus comprising:

a body of the image forming apparatus; and a cartridge configured to be installed with respect to the body, wherein the cartridge includes:

a developer accommodating portion configured to accommodate a developer;

a developing portion configured to support a developer holding member configured to hold the developer thereon; and a shutter configured to be movable between an open position at which the shutter opens a communication port allowing the developer accommodating portion to communicate with the developing portion, and a closed position at which the shutter closes the communication port, the body includes:

a detecting means for detecting a state of the cartridge which changes as the cartridge is used;

a shutter driving gear configured to drive the shutter, wherein the shutter is configured to move between the open position and an intermediate position, which is located between the open and closed positions, under a condition that an image forming operation is being executed; and a controller connected to the detecting means, the controller being configured to judge whether a cartridge exchange timing for exchanging the cartridge has arrived, based on the state of the cartridge detected by the detecting means, and configured to control the shutter driving gear to move the shutter from the open position to the closed position when the controller judges that the cartridge exchanging timing has arrived.

2. The image forming apparatus according to claim 1, wherein the detecting means is configured to detect the amount of the developer inside the developer accommodating portion, and the controller is configured to judge whether the cartridge exchange timing has arrived based on the amount of the developer.

3. The image forming apparatus according to claim 1, wherein the developer accommodating portion is undetachable from the developing portion.

4. The image forming apparatus according to claim 1, wherein the developer accommodating portion includes a transporting member configured to transport the developer to the developing portion, the body includes a position sensor for detecting a position of the transporting member, and the shutter is configured to move to the closed position under a condition that the position of the transporting member detected by the position sensor is a non-interfering position at which the transporting member does not interfere with the shutter.

5. The image forming apparatus according to claim 1, wherein the shutter is configured to pivot between the open position and the closed position.

6. The image forming apparatus according to claim 1, wherein the shutter is configured to be located at the open position in a case that the cartridge is unused.

7. The image forming apparatus according to claim 1, wherein the detecting means includes a developer empty sensor configured to detect an amount of the developer in the developer accommodating portion.

8. The image forming apparatus according to claim 1, wherein the detecting means is configured to detect the number of dots of a print pattern or the number of rotations of the developer holding member.

* * * * *